US005452986A

United States Patent [19]

Osborne et al.

[11] Patent Number: 5,452,986

[45] Date of Patent: Sep. 26, 1995

[54] VANED DIFFUSER

[75] Inventors: Colin Osborne, Norwich, Vt.; Martin D. Maier, Olean, N.Y.

[73] Assignee: Dresser-Rand Company, Corning, N.Y.

[21] Appl. No.: 180,447

[22] Filed: Jan. 12, 1994

[51] Int. Cl.[6] ..... F04D 27/00

[52] U.S. Cl. ..... 415/165; 415/150

[58] Field of Search ..... 415/148, 150, 415/157, 158, 159, 165

[56] References Cited

U.S. PATENT DOCUMENTS

| | | | |
|---|---|---|---|
| 3,330,532 | 7/1967 | Willi | 415/158 |
| 3,749,513 | 7/1973 | Chute | 415/158 |
| 4,403,914 | 9/1983 | Rogo et al. | 415/165 |
| 4,657,481 | 4/1987 | Mowill et al. | 415/158 |
| 5,267,829 | 12/1993 | Schmidt et al. | 415/157 |

FOREIGN PATENT DOCUMENTS

| | | | |
|---|---|---|---|
| 66726 | 3/1992 | Japan | 415/165 |

*Primary Examiner*—John T. Kwon

*Attorney, Agent, or Firm*—Richards, Medlock & Andrews

[57] ABSTRACT

A vaned diffuser is provided. The diffuser comprises a housing having a first and second flow wall defining a flow path for the exit flow from an impeller. Twisted vanes are mounted on a movable structure capable of travel inside a chamber adjacent the first flow wall. The twisted vanes extend through rotatable structures rotatably retained in the flow walls such that the twisted vanes are slidably disposed across the flow path. Lateral movement of the movable structure moves the twisted vanes through the exit flow thus varying the stagger angle of the vane depending on which section of the twisted vane is in the exit flow. The rotatable structures have twisted openings that match the vane cross-section and twist so that the rotatable structures readily rotate as the twisted vanes are moved through them.

28 Claims, 4 Drawing Sheets

FIG. 2
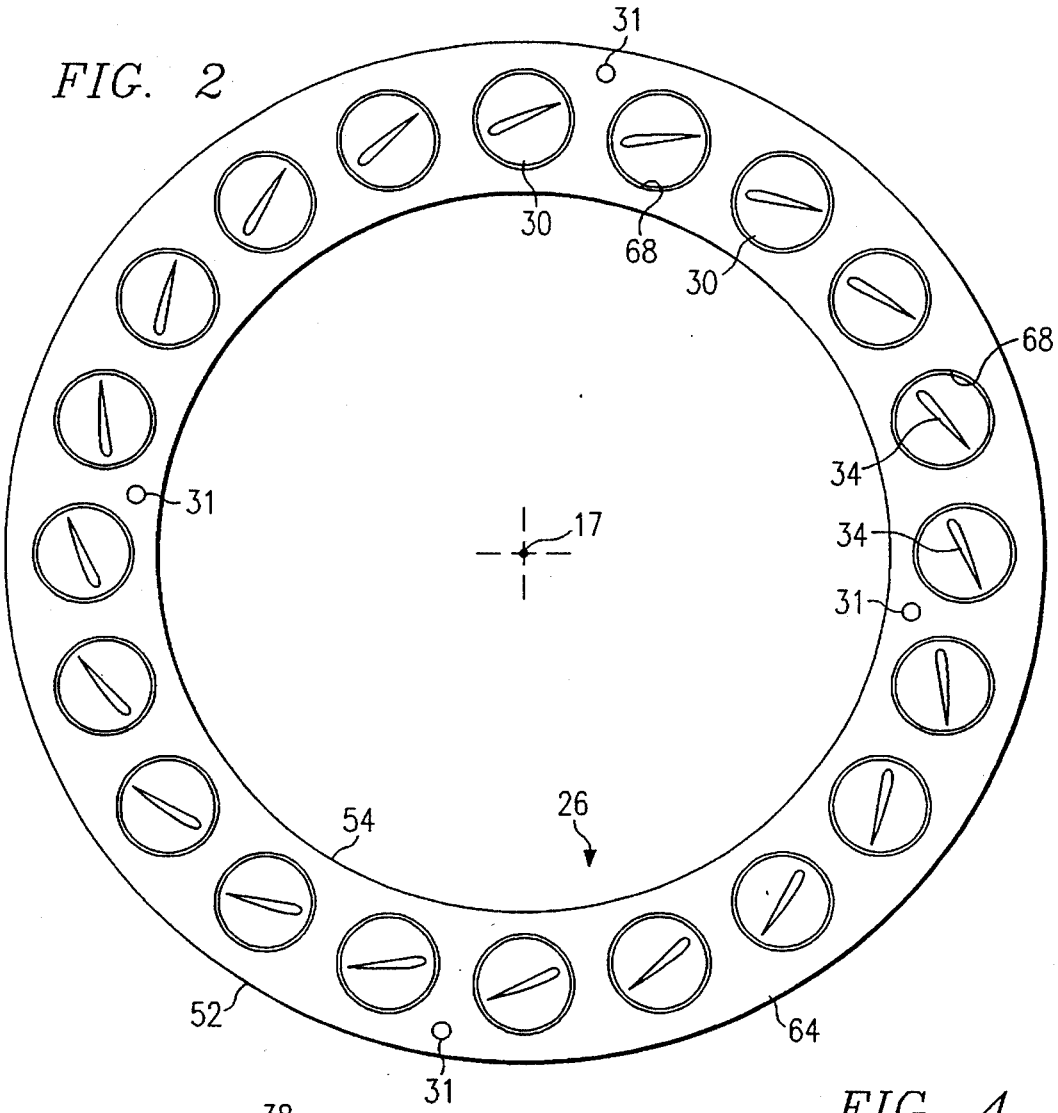
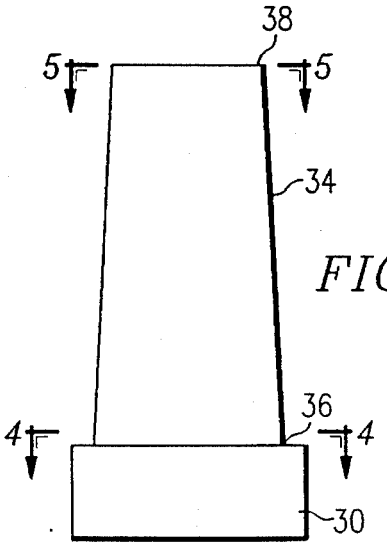
FIG. 3
FIG. 4
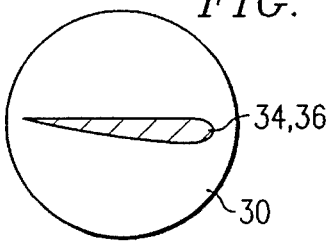
FIG. 5
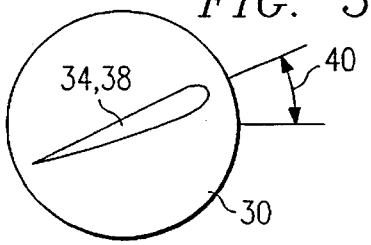

VANED DIFFUSER

TECHNICAL FIELD OF THE INVENTION

This invention relates to vaned diffusers for turbomachinery. In one aspect, it relates to a vaned diffuser with vanes capable of being linearly moved transverse to the direction of exit flow from a turbomachinery rotor or impeller.

BACKGROUND OF THE INVENTION

While vaned diffusers can achieve superior performance relative to vaneless diffusers, this superior performance can, in general, only be achieved over a limited range of flow rates. In contrast, vaneless diffusers, while not capable of the superior performance of vaned diffusers, can maintain an acceptable performance over a broad range of flow rates. In order to achieve the high performance of a vaned diffuser over a broad range of flow rates, many systems have been suggested that enable the setting angle of the diffuser vanes to be varied continuously with flow rate. This allows acceptable diffuser incidence angles to be maintained over a broader range of flow rates. However, existing variable geometry systems are characterized by complicated linkages that rotate each diffuser vane by an appropriate amount in response to the varying flow rate. These systems are expensive and are prone to mechanical problems due to the multiplicity of moving parts needed to rotate all the vanes. Thus, a need exists for an inexpensive, simplified mechanism that can appropriately vary the setting angle of the vanes as the flow rate varies.

Diffuser vanes are normally designed with a constant geometry such that the entire height of the vane has the same setting angle. The exit flow profile from an impeller, however, is typically distorted and nonconstant depending on the design details of the impeller as well as overall parameters such as specific speed. Thus, a vane set to a particular stagger angle might match with part of the flow while mismatching with other parts of the flow. For example, if a diffuser vane is adjusted such that its angle of incidence matches the exit flow at the hub, most likely the angle of incidence of the vane will not match the exit flow at the shroud. This lack of incidence matching creates undesired inefficiencies. Thus, a need exists for a diffuser vane that provides improved angle of incidence matching between the vane leading edge and the exit flow from the impeller and maintains desired incidence angles as the flow rate is varied via the use of a simple variable geometry system.

SUMMARY OF THE INVENTION

The present invention provides a vaned diffuser that can achieve the superior performance associated with vaned diffusers but over a broader range of flow rates. One aspect of the present invention provides a variable setting angle along the leading edge of each of a plurality of axially movable vanes to permit better incidence matching with the exit flow from the impeller. The present invention is also much simpler and uses less moving parts than typical adjustable vaned diffusers that rotate the vanes.

The vaned diffuser comprises a housing surrounding an impeller and having first and second flow walls opposite each other to define a flow path for the exit flow of pressurized fluid from the impeller. The housing also defines first and second chambers adjacent the first and second flow walls, respectively. Each flow wall has a plurality of holes which align with a plurality of holes on the other flow wall.

A rotatable structure, which can be in the form of a disk, can be rotatably mounted in each hole. Each rotatable structure has an opening therethrough along its axis of rotation which is at least substantially parallel to the impeller axis of rotation. A linearly movable structure is slidably disposed in the first chamber and is capable of being moved in either direction along a line which is at least substantially parallel to the impeller axis of rotation. A plurality of twisted vanes, each having a first end and a second end, are connected at their first ends to the movable structure and slidably extend through the openings in the rotatable structures in the first flow wall, across the flow path, and through the openings in the rotatable structure in the second flow wall. The second end of each of the plurality of twisted vanes is disposed in the second chamber.

In operation, the movable structure can be longitudinally moved parallel to the impeller axis of rotation to various positions within the first chamber. This causes a longitudinal motion of the twisted vanes through the openings in the opposed rotatable disk structures. The openings in the rotatable disk structures are dimensioned slightly larger than the cross-section of the vanes and, in a preferred embodiment, have approximately the same degree of twist as the vanes. This allows the rotatable disk structures to readily rotate as the twisted vanes are moved longitudinally through the openings. As the vanes are moved through the flow path of the fluid exiting the impeller, the angle of incidence of the vanes changes with respect to the fluid flow as a result of the twist of the vanes. This allows an improved angle of incidence matching between the vanes and the exiting fluid flow. As the exit flow rate changes, the vanes can be moved longitudinally along their axes to optimally match their angle of incidence with the new fluid flow rate.

BRIEF DESCRIPTION OF THE DRAWINGS

FIG. 2 is a view, in a plane perpendicular to the axis of rotation of the impeller, of the movable structure of FIG. I with a plurality of vanes associated therewith;

FIG. 3 is a side view of a twisted vane and its vane pedestal;

FIG. 4 is a cross-sectional view along line 4—4 of FIG. 3;

FIG. 5 is an end view along line 5—5 of FIG. 3;

DETAILED DESCRIPTION OF THE PREFERRED EMBODIMENT

Figures 1, 6:
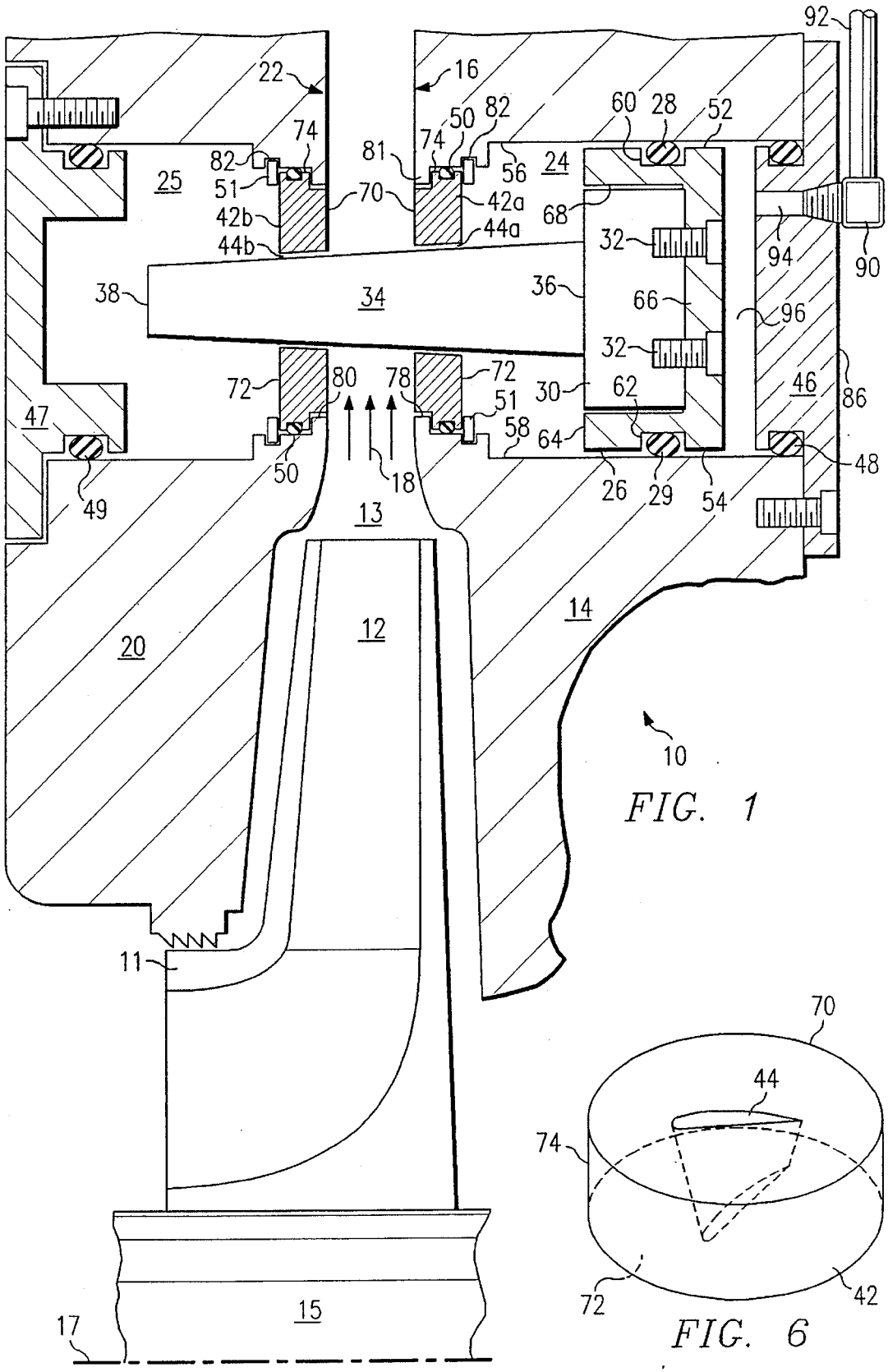
FIG. 1 is a cut-away view along a radial plane containing the axis of rotation of the impeller in a preferred embodiment of the vaned diffuser of the present invention.
FIG. 6 is a perspective view of one of the rotatable disks.

With reference to the accompanying FIGS. 1–6, wherein like reference numerals designate like or corresponding parts throughout the several views, the preferred embodiment of the present invention is explained hereinafter.

FIG. 1 shows a cut-away profile in a radial plane of the preferred embodiment of the vaned diffuser of the present invention. The impeller 11 is rotatably mounted on a shaft 15 for the rotation of impeller blades 12 about the longitudinal axis 17 of shaft 15. Diffuser housing 10 extends circumferentially about the periphery of impeller 11, and has an annular chamber 13 to receive the flow from the rotating blades 12 of the impeller 11. Diffuser housing 10 also has an annular exiting flow path 18 extending radially outwardly from annular chamber 13 for the flow, represented by the arrows, of pressurized fluid exiting from impeller 11. The exiting flow path 18 is formed by first flow wall 16 of housing element 14 bordering one side of the exiting flow path 18, and the second flow wall 22 of housing element 20 bordering the opposite side of the exiting flow path 18. First flow wall 16 has a plurality of holes 78 formed therein which are spaced at radial distances from the longitudinal axis 17 of shaft 15 to form an array surrounding impeller blades 12, with the spacings between adjacent holes 78 in the array being at least substantially uniform. The second flow wall 22 has a plurality of holes 80, the positions of which correspond to and are in alignment with the positions of holes 78 in first flow wall 16. Housing element 14 defines a first chamber 24 adjacent to first flow wall 16, with each of the holes 78 extending between first chamber 24 and flow path 18. Housing element 20 defines a second chamber 25 which is adjacent to second flow wall 22, with holes 80 extending between second chamber 25 and flow path 18.

A plurality of rotatable structures 42*a* are provided, with each rotatable structure 42*a* being positioned in a respective opening 78 in housing element 14. Similarly, a plurality of rotatable structures 42*b* are provided, with each rotatable structure 42*b* being positioned in a respective opening 80 in housing element 20. In the preferred embodiment, each of the rotatable structures 42*a*, 42*b* is a generally cylindrical disk with a flow face 70 which is substantially flush with the flow wall 16 or 22 in which it is mounted. Each of the rotatable structures 42*a*, 42*b* also has a chamber face 72 which faces away from flow path 18. An annular element 50 is positioned between the generally circular periphery 74 of each rotatable structure 42*a* and the inside surface of the hole 78 in which the structure 42*a* is rotatably mounted. Similarly, an annular element 50 is positioned between the generally circular periphery 74 of each rotatable structure 42*b* and the inside surface of the hole 80 in which the structure 42*b* is rotatably mounted. Annular elements 50, which can be formed of flexible elastomeric material, facilitate the rotation of rotatable structures 42*a* and 42*b* in holes 78 and 80, respectively. In the presently preferred embodiment, annular elements 50 are O-rings. The annular surface forming each opening 78, 80 has an annular radially extending flange 81 forming a portion of the respective flow wall surface 16, 22 and an annular groove 82 spaced from the flange 81 to receive the rotatable structure 42*a*, 42*b* therebetween. A retaining element 51, which can be a C ring, can be positioned in an annular groove 82 to contact the chamber face 72 of the respective rotatable structure 42*a*, 42*b* to retain the rotatable structure in place in the housing 10 while permitting the rotatable structure 42*a*, 42*b* to rotate freely about its longitudinal axis.

Rotatable structures 42*a* and 42*b* do not need to have the same diameter or the same thickness, but it is preferred that the axis of rotation of each rotatable structure 42*a* and the axis of rotation of the correspondingly positioned rotatable structure 42*b* be the same, i.e., they are mounted coaxially. Each rotatable structure 42*a* has an opening 44*a* extending therethrough coaxially with the axis of rotation of the respective structure 42*a*. Similarly, each rotatable structure 42*b* has an opening 44*b* extending therethrough coaxially with the axis of rotation of the respective structure 42*b*. In the preferred embodiment openings 44*a* and 44*b* are twisted slots, and the opening 44*a* in a structure 42*a* has a common axis with the opening 44*b* in the correspondingly positioned structure 42*b*. The illustrations of slot openings 44*a* and 44*b* in FIG. 1 differ because the orientations of the slot openings correspond to different positions along the longitudinal axis of the twisted vane 34.

Movable structure 26 is positioned within first chamber 24 and is capable of travel in either direction along a line which is at least generally parallel to the longitudinal axis of vane 34. In the presently preferred embodiment, movable structure 26 is an annular ring having an outer peripheral cylindrical surface 52 and inner peripheral cylindrical surface 54, first chamber 24 is an annular chamber having an outer cylindrical wall surface 56 and an inner cylindrical wall surface 58, and both ring 26 and first chamber 24 are positioned coaxially with shaft 15. The outer peripheral cylindrical surface 52 and inner peripheral cylindrical surface 54 of ring 26 are slidable along outer cylindrical wall surface 56 and inner cylindrical wall surface 58 of first chamber 24, respectively. The annular groove 60 can be provided in outer peripheral wall surface 52 to receive a flexible sealing element 28 to provide a seal between outer peripheral wall surface 52 of ring 26 and the outer cylindrical wall surface 56 of first chamber 24. Similarly, annular groove 62 can be provided in inner peripheral wall surface 54 to receive a flexible sealing element 29 to provide a seal between inner peripheral wall surface 54 of ring 26 and the inner cylindrical wall surface 58 of first chamber 24. Sealing elements 28 and 29 can be any suitable sealing elements, e.g., polytetrafluoroethylene O-rings, which facilitate linear travel of ring 26 while maintaining a snug fit between ring 26 and the inside of first chamber 24. The ring 26 has a first end 64 facing towards flow path 18 and a second end 66 facing away from flow path 18. A plurality of openings 68 are spaced uniformly about the circumferential extent of first end 64, with each opening 68 receiving pedestal 30 of a respective vane 34. Threaded fasteners 32 can extend from the second end 66 through the ring 26 into each vane pedestal 30 to secure the vane 34 in place. One end of each twisted vane 34 is connected to its associated vane pedestal 30. Each twisted vane 34 slidably extends through the openings 44*a* and 44*b* in its associated pair of rotatable disks 42*a*, 42*b*, with the second end 38 of the vane 34 being disposed in the second annular chamber 25.

In FIG. 2 each of a plurality vane pedestals 30 is positioned in its associated opening 68 in the first end face 64 of ring 26, with the openings 68 being arranged in a circular pattern concentric with the rotational axis 17 of impeller 11. One or more passageways 31 can be provided in ring 26 extending from end 64 to end 66 to equalize the pressure on each side of ring 26 in first chamber 24. For the sake of simplicity the twist of vanes 34 is not illustrated in FIG. 2.

FIGS. 3–5 show the preferred embodiment of twisted vanes 34. Each twisted vane 34 has a first end 36 and a second end 38. The longitudinal axis of each twisted vane 34 is defined as running from first end 36 to second end 38, and is preferably at least generally parallel to the longitudinal axis 17 of shaft 15. The cross-sectional shape of each twisted vane 34 is substantially constant along the longitudinal axis of the vane 34, although the setting angle of the cross-sectional shape varies. This constant cross-sectional shape of the vane 34 corresponds to the constant cross-sectional shape of the openings 44*a*, 44*b*, with the rate of twist of the cross-sectional shape of openings 44*a*, 44*b* also varying along the length of the opening. The first end 36 of each vane 34 is fixed to the associated vane pedestal 30 at a certain orientation, as shown in FIG. 4. The vane 34 is twisted such that the second end 38, shown in FIG. 5, is oriented at a angle 40 to the orientation of the first end 36, shown in FIG. 4. The axis of twist is parallel to, and preferably coaxial with, the longitudinal axis of the vane 34. The rate of twist can be constant in that the rate of change in angle 40 per unit length can be constant.

FIG. 6 is a perspective of a rotatable structure 42 having an opening 44 in the form of a twisted slot. Opening 44 is dimensioned slightly larger than the cross-section of twisted vanes 34 and is twisted at the same degree as an equivalent length of twisted vane 34 so as to allow the free movement of twisted vane 34 through the opening 44 without binding. In the preferred embodiment, rotatable structures 42 are made from polytetrafluoroethylene which can be successfully used in low stress applications at temperatures up to 450° F. Polytetrafluoroethylene discs 42 facilitate the machining of openings 44 and provide a low coefficient of sliding friction. Rotatable structures 42 can also be cast with openings 44, thereby eliminating the intricate machining operations associated with cutting the openings. In an alternative embodiment, the rotatable structure 42 can be made from an abradable material. The clearance between the twisted vanes 34 and the openings 44 can be such as to minimize flow loss. Final clearances will be established as the twisted vane 34 and opening 44 wear together.

With reference back to FIG. 1, the end of first chamber 24 remote from exit path 18 can be sealed by first coverplate 46. An O-ring 48 can be installed between housing element 14 and coverplate 46 for sealing purposes. Coverplate 47 and O-ring 49 are used to similarly seal the end of second chamber 25 which is remote from exit path 18.

Coverplate 46 has hydraulic fitting 90 and hydraulic supply line 92 connected to the outside 86 of coverplate 46. Hole 94 in coverplate allows communication of hydraulic pressure in line 92 with pressure chamber 96. Pressure or a vacuum can be acted upon chamber 96 to move ring 26 in the desired direction.

It should be understood that movable structure 26 can just as easily be located in housing element 20 instead of housing element 14. The present invention is not limited by which side of the impeller the movable structure is located.

Figure 7:
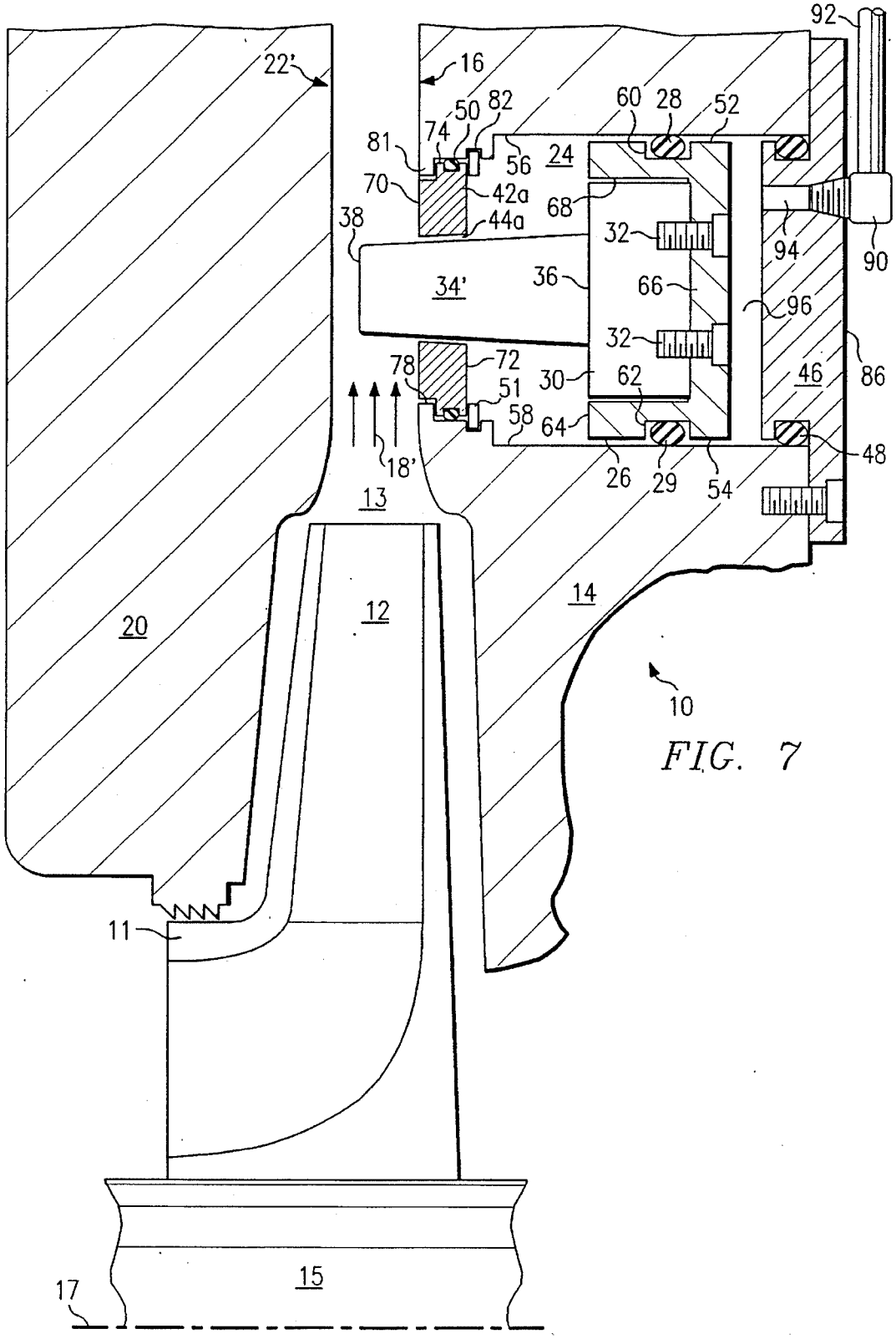
FIG. 7 is a cut-away view along a radial plane containing the axis of rotation of the impeller in an alternative embodiment of the vaned diffuser of the present invention.

FIG. 7 shows an alternative embodiment where twisted vane 34' only extends partially into flow path 18'. Second flow wall 22' is continuous and vane 34' is sized so that vane 34' can be extended across flow path 18' at the desired length. It should be understood that in a further embodiment FIG. 7 can be reversed such that vane 34' extends through second flow wall 22' only instead of flow wall 16 only. In such an embodiment, movable structure 26 and first chamber 24 would actually be in housing element 20. Thus, the embodiment of FIG. 7 is not limited by which wall through which vanes 34' extend.

Figure 8:
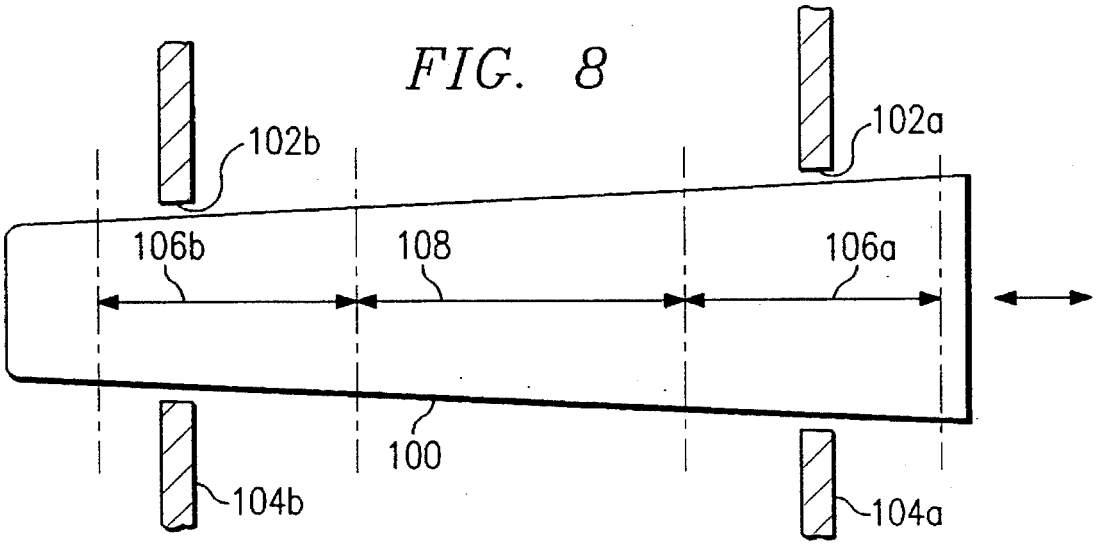
FIG. 8 is a side view of an alternative embodiment of a vane for use in the embodiment of FIG. 1.

FIG. 8 illustrates an alternative embodiment regarding the manner in which the vane is twisted. Specifically, vane 100 of FIG. 8 only needs a constant rate of twist along the length of vane 100 that will actually travel through holes 102 of rotatable structures **104*a* and 104*b*. Because vane 100 will only be moved through a limited range of linear travel in operation, it can be seen that the constant rate of twist of the vane to match the constant rate of twist of holes 102*a* and 102*b* only needs to be present along that range of the vane which could potentially be moved through holes 102*a* and 102*b*. Thus, a first portion 106*a* of vane 100 has a first substantially constant rate of twist, a second portion 106*b* of vane 100 has a second substantially constant rate of twist, and middle portion 108 can have a variable rate of twist or no twist at all. The first substantially constant rate of twist and the second substantially constant rate of twist can be different or the same. Furthermore, the middle portion could even have a non-uniform cross-section or other geometrical deviations. The embodiment of FIG. 8** allows potentially improved matching of vane geometry with the exit flow characteristics.

Figure 9:
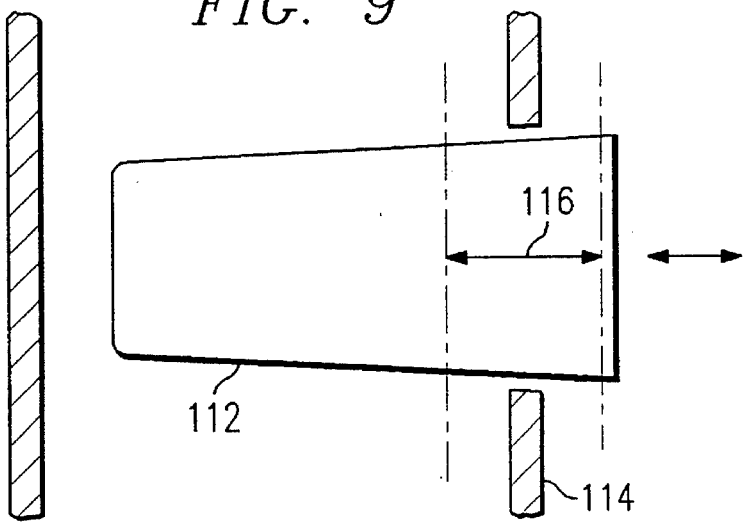
FIG. 9 is a side view of an alternative embodiment of a vane for use in the embodiment of FIG. 7.

FIG. 9 illustrates an alternative embodiment of a vane for use in the embodiment of FIG. 7. Because vane 110 only extends through one wall, vane 110 only needs a constant rate of twist along the length of vane 110 that will potentially actually travel through holes 112 of rotatable structure 114. Thus, first portion 116 of vane 110, which is the only portion which will potentially travel through rotatable structure 114, has a substantially constant rate of twist. Second portion 118 can have a variable rate of twist or not twist at all. The second portion may also have a non-uniform cross-section or other geometrical deviations.

In operation of the preferred embodiment, as movable structure 26 is linearly moved within first chamber 24, twisted vanes 34 slide longitudinally through the openings **44*a*, 44*b* in rotatable structures 42*a* and 42*b*. Due to the twist in the twisted vanes 34, the longitudinal motion of the twisted vanes causes rotatable structures 42*a* and 42*b* to rotate as openings 44*a* and 44*b* follow the twist of the twisted vanes. Thus, the twisted vanes 34 turn with respect to the exiting fluid flow when they are being moved linearly through the exiting flow path 18. A mechanical, hydraulic or pneumatic jacking mechanism can be used to longitudinally move the ring structure 26 in either direction in first chamber 24**.

Since the exit flow from the impeller 11 can vary from the first flow wall 16 to the second flow wall 22, the twist in twisted vanes 34 allows for better incidence matching of the vanes across the exit flow. As the rate of the exit flow changes, the stagger angle of vanes 34 can be easily changed by the simple linear movement of movable structure 26, thereby achieving appropriate incidence angles as the flow rate is changed. This preferred embodiment of the present invention can achieve the high performance of the traditional vaned diffusers over a wide range of flow rates.

Although the present invention has been described with respect to a specific preferred embodiment thereof, various changes and modifications may be suggested to one skilled in the art, and it is intended that the present invention encompass such changes and modifications as fall within the scope of the appended claims. For example, annular chambers 24 and 25 and ring 26 could be replaced by a plurality of first chambers, a plurality of second chambers, and a plurality of movable structures, with each movable structure being positioned within a respective first chamber and supporting a vane which extends through a rotatable disk **42*a*, the exit flow path, and the corresponding rotatable disk 42*b*** into the correspondingly positioned second chamber.

We claim:

1. A vaned diffuser for diffusing exit flow from a rotating impeller, comprising:

(a) A housing having first and second flow walls opposite each other defining a flow path for the exit flow, said housing defining a chamber adjacent said first flow wall, said first flow wall having a plurality of holes;

(b) a movable structure slidably disposed in said first chamber that is capable of being linearly moved in a direction approximately parallel to said impeller's axis of rotation;

(c) a plurality of twisted vanes connected to said movable structure, each of said plurality of vanes being slidably disposed through one of said plurality of holes in said first flow wall and into said flow path.

2. The vaned diffuser of claim 1 wherein said first chamber is annular having an outer wall and an inner wall and said movable structure is a ring having an outer periphery and an inner periphery slidable along the outer and inner walls, respectively, of said first chamber.

3. The vaned diffuser of claim 1 wherein each of said plurality of twisted vanes has a first end at said movable structure and a second end disposed in the flow path, each vane having a longitudinal axis running from said first end to said second end and being twisted about an axis parallel to the longitudinal axis.

4. A vaned diffuser in accordance with claim 1 wherein each of said plurality of twisted vanes has a first portion with a substantially constant rate of twist, and a second portion.

5. The vaned diffuser of claim 4 wherein the second portion has a constant rate of twist.

6. The vaned diffuser of claim 4 wherein the second portion has a variable rate of twist.

7. The vaned diffuser of claim 4 wherein the second portion is of a nonuniform geometry.

8. A vaned diffuser for diffusing exiting fluid flow from a impeller, said impeller being positioned for rotation about its longitudinal axis, said diffuser comprising:

a housing positioned about said impeller and having first and second flow walls opposite each other defining a flow path for the fluid flow exiting from said impeller, said housing defining a first chamber adjacent said first flow wall, said housing defining a second chamber adjacent said second flow wall, said first flow wall having a first plurality of holes, said second flow wall having a second plurality of holes, each of said first plurality of holes in said first flow wall being aligned with a respective one of said second plurality of holes in said second flow wall;

a first plurality of rotatable structures, each of said first plurality of rotatable structures being rotatably mounted in a respective one of said first plurality of holes, a second plurality of rotatable structures, each of said second plurality of rotatable structures being rotatably mounted in a respective one of said second plurality of holes, each of said first plurality of rotatable structures and each of said second plurality of rotatable structures having an axis of rotation which is at least substantially parallel to the axis of rotation of the impeller and having an opening extending therethrough along the axis of rotation of the respective rotatable structure;

a moveable structure slidably disposed in said first chamber so as to be capable of being moved in either direction along a longitudinal line which is at least substantially parallel to the axis of rotation of the impeller; and a plurality of twisted vanes mounted to said moveable structure, each of said plurality of twisted vanes being slidably disposed through the opening of a respective one of said first plurality of rotatable structures in said first flow wall, through said flow path and through the opening of a respective one of said second plurality of rotatable structures in said second flow wall.

9. A vaned diffuser in accordance with claim 8 wherein each of said first plurality of rotatable structures and each of said second plurality of rotatable structures is generally cylindrical and has a flow face which is substantially flush with the flow wall in which it is mounted, a chamber face facing away from said flow path, and a generally circular periphery rotatably engaged with the inside of the hole in which it is mounted.

10. A vaned diffuser in accordance with claim 9 further comprising a plurality of sealing elements, each sealing element being positioned between the periphery of a respective rotatable structure and the inside of the hole in which the respective rotatable structure is mounted.

11. A vaned diffuser in accordance with claim 9 further comprising a plurality of retaining elements, each retaining element extending from the inside of a respective hole and over the chamber face of the rotatable structure contained in the respective hole to retain the rotatable structures in the holes.

12. A vaned diffuser in accordance with claim 1 wherein said first chamber is annular having an outer wall and an inner wall and said movable structure is a ring having an outer periphery and an inner periphery slidable along the outer and inner walls, respectively, of said first chamber.

13. A vaned diffuser in accordance with claim 8 wherein each of said plurality of twisted vanes has a first end at said movable structure and a second end disposed in said second chamber, each twisted vane having a longitudinal axis running from said first end to said second end and having an axis of twist parallel to the longitudinal axis.

14. A vaned diffuser in accordance with claim 13 wherein the openings in the rotatable structures are dimensioned slightly larger than the cross-section of at least a portion of the twisted vanes.

15. A vaned diffuser in accordance with claim 8 wherein each of said plurality of twisted vanes has a substantially constant rate of twist.

16. A vaned diffuser in accordance with claim 8 wherein each of said plurality of twisted vanes has a first portion with a first substantially constant rate of twist, a second portion with a second substantially constant rate of twist, and a middle portion between the first and second portion.

17. The vaned diffuser of claim 16 wherein the middle portion has a constant rate of twist.

18. The vaned diffuser of claim 16 wherein the middle portion has a variable rate of twist.

19. The vaned diffuser of claim 16 wherein the middle portion is of a nonuniform geometry.

20. A vaned diffuser for diffusing exit flow from a rotating impeller, comprising:

(a) a housing having first and second flow walls opposite each other defining a flow path for the exit flow, said housing defining a first chamber and a second chamber adjacent said first and second flow walls respectively, said first and second flow walls each having a plurality of holes, each of said plurality of holes in said first flow wall being aligned with one of said plurality of holes in said second flow wall;

(b) a plurality of rotatable structures, each rotatable structure being rotatably mounted in a respective one of said plurality of holes in said first flow wall and said plurality of holes in said second flow wall, each said rotatable structure having an opening and having an axis of rotation approximately parallel to the impeller's axis of rotation;

(c) a movable structure slidably disposed in said first chamber that is capable of being linearly moved in a direction approximately parallel to said impeller's axis of rotation;

(d) a plurality of twisted vanes mounted to said movable structure, each of said plurality of vanes being slidably disposed through the opening of one of said rotatable structures in said first flow wall, through said flow path and through the opening of one of said rotatable structures in said second flow wall.

21. A vaned diffuser in accordance with claim 13 wherein each of said rotatable structures is generally cylindrical and has a flow face which is substantially flush with the flow wall in which it is mounted, a chamber face facing away from said flow path, and a generally circular periphery rotatably engaged with the inside of the hole in which it is mounted.

22. A vaned diffuser in accordance with claim 21 further comprising a sealing element between the periphery of each rotatable structure and the inside of each hole.

23. A vaned diffuser in accordance with claim 21 further comprising a plurality of retaining elements, each retaining element extending from the inside of a respective hole and over the chamber face of the rotatable structure contained in the respective hole to retain the rotatable structures in the holes.

24. A vaned diffuser in accordance with claim 20 wherein said first chamber is annular having an outer wall and an inner wall and said movable structure is a ring having an outer periphery and an inner periphery slidable along the outer and inner walls, respectively, of said first chamber.

25. A vaned diffuser in accordance with claim 20 wherein each of said plurality of twisted vanes has a first portion with a first substantially constant rate of twist, a second portion with a second substantially constant rate of twist, and a middle portion between the first and second portion.

26. The vaned diffuser of claim 25 wherein the middle portion has a constant rate of twist.

27. The vaned diffuser of claim 25 wherein the middle portion has a variable rate of twist.

28. The vaned diffuser of claim 25 wherein the middle portion is of a nonuniform geometry.

* * * * *

UNITED STATES PATENT AND TRADEMARK OFFICE

CERTIFICATE OF CORRECTION

PATENT NO. : 5,452,986

DATED : September 26, 1995

INVENTOR(S) : Colin Osborne et al

It is certified that error appears in the above-indentified patent and that said Letters Patent is hereby corrected as shown below:

Column 8, line 15, delete "claim 1" and insert --claim 8--.

Column 9, line 5, delete "claim 13" and insert --claim 20--.

Signed and Sealed this

Thirtieth Day of January, 1996

Bruce Lehman

*Attest:*

BRUCE LEHMAN

*Attesting Officer*

*Commissioner of Patents and Trademarks*